United States Patent [19]

Siegmund

[11] 4,031,423

[45] June 21, 1977

[54] CHANNEL STRUCTURE FOR MULTI-CHANNEL ELECTRON MULTIPLIERS AND METHOD OF MAKING SAME

[75] Inventor: Walter P. Siegmund, Woodstock, Conn.

[73] Assignee: American Optical Corporation, Southbridge, Mass.

[22] Filed: Apr. 30, 1969

[21] Appl. No.: 823,245

[52] U.S. Cl. ..... 313/105 CM; 65/4 R; 65/4 A; 65/37; 65/DIG. 7

[51] Int. Cl.[2] ..... H01J 43/00

[58] Field of Search ..... 313/103, 252, 103 R, 313/103 CM, 104, 105 R, 105 CM; 65/4 R, 4 A, 37, DIG. 7

[56] References Cited

UNITED STATES PATENTS 3,243,642 3/1966 Gebel ..... 313/103 X

*Primary Examiner*—Maynard R. Wilbur
*Assistant Examiner*—T. M. Blum
*Attorney, Agent, or Firm*—H. R. Berkenstock, Jr.; William C. Nealon

[57] ABSTRACT

An electron multiplier channel structure having channel walls formed of alternate strips of different glasses. One glass has optimum electrical conductivity properties and the other glass has optimum secondary electron-emitting properties. The strips are contiguous so that electrical conducting strips can readily supply electrons to neighboring electron emitting strips when an electrical potential is applied across the multi-channel structure.

4 Claims, 9 Drawing Figures

INVENTOR.
WALTER P. SIEGMUND

BY Robert T. Williams
ATTORNEY

CHANNEL STRUCTURE FOR MULTI-CHANNEL ELECTRON MULTIPLIERS AND METHOD OF MAKING SAME

BACKGROUND OF THE INVENTION

1.Field of the Invention

Electron multipliers with particular reference to electron multiplying channel structures and method of making same.

2. Description of the Prior Art

Glass multi-channel structures for electron multiplication in image intensifier tubes and the like are commonly formed of lead containing glasses which are treated in a reducing atmosphere to produce lead-enriched surfaces serving both as electrical conductors and as secondary electron emitters for electrons colliding with walls of the channels. Accordingly, it it necessary to select a glass which satisfactorily performs the two functions of conducting electrical current and emitting secondary electrons.

The present invention relates to an improvement in multi-channel structures wherewith an optimum in both conductivity and secondary emission properties of the structure may be accomplished without compromise between the two.

SUMMARY OF THE INVENTION

The basic concept of this invention is to provide alternate strips of two different glasses around the inside wall of each channel of a multi-channel structure with one glass having or acquiring through subsequent treatment, optimum conductivity properties and the other glass having, or acquiring, optimum secondary electron-emitting properties. The glass strips are contiguous so that those having high conductivity can readily supply electrons to the neighboring electron-emitting strips.

It is contemplated that the two different glasses in alternate strips be formulated to achieve their optimum behavior, one as a semiconductor and the other as a secondary-electron emitter with the same post treatment such as firing in a reducing atmosphere. These glasses, for example, may differ in the amount of lead they contain, the higher lead content leading to higher conductivity. Alternatively, two glasses each having the desired properties and not requiring post treatment may be used. For example, relativey high electrical conductivity is found in vanadium containing glasses and relatively high secondary-electron emission properties are found in common nonconductive glasses such as standard soda-lime glass.

Details of the invention will become more fully understood by reference to the following description and the accompanying drawing.

DESCRIPTION OF THE PREFERRED EMBODIMENTS

Figure 1:
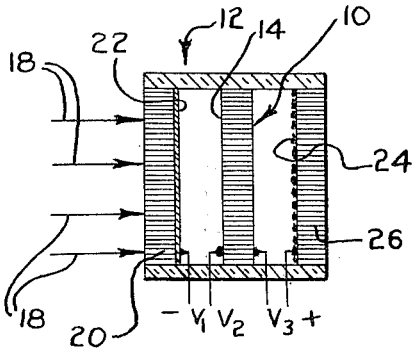
FIG. 1 is a diagrammatic cross-sectional view of an exemplary image amplifier incorporating an embodiment of this invention.

Channel plate 10 internally of image intensifier tube 12 (FIG. 1) is exemplary of a type of multi-channel structure to which this invention is more particularly directed.

Plate 10 having many thousand parallel channels each in the order of from 10 to 30 microns in diameter, for example, and extending from one face 14 to another face 16 thereof is adapted to receive a pattern of electrons corresponding to the pattern of an image intended to be intensified by tube 12.

In the illustrated embodiment of tube 12, image forming light represented by the arrows 18 is directed through face plate 20 upon photocathode 22 which emits image forming electrons. An electrical potential, $V_1$ (e.g. 500V.), applied between the photocathode and the channel plate 10 draws the image forming electrons to face 14. Another potential $V_2$ (e.g. 1000 V.) accelerates them through the channels in plate 10 with multiplication by secondary emission of electrons from walls of the channels taking place. The pattern of electrons, amplified by multiplication in plate 10, is accelerated to the phosphor layer 24 within tube 12 by another potential $V_3$ (e.g. 5000 V.) and is converted into a correspondingly intensified light image. The light image is transmitted through output face plate 26 of tube 12. Face plates 20 and 26 may be formed of light conducting fibers fused together in vacuum tight side-by-side relationship with each other as illustrated or each may comprise a solid glass plate.

Figure 8:
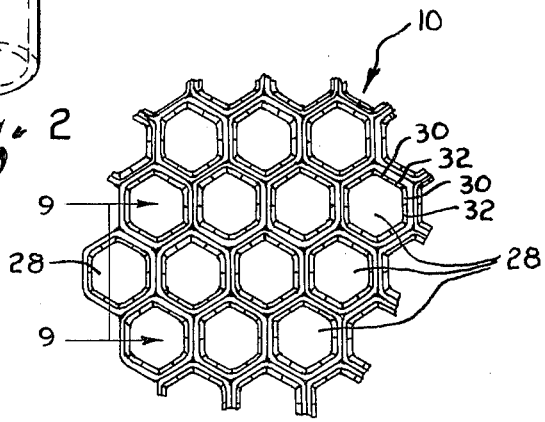
FIG. 8 is an enlarged fragmentary face view of an electron multiplier element resulting from the method steps represented in FIGS. 2–7.
Figure 9:
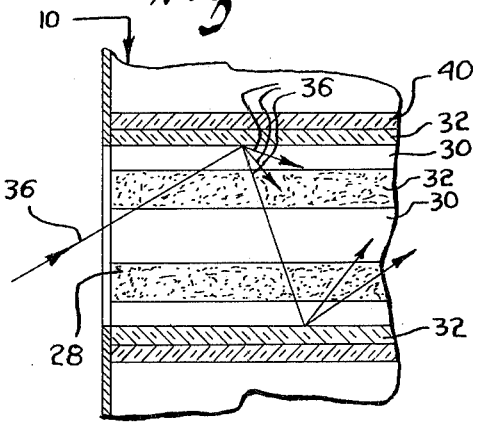
FIG. 9 is a greatly enlarged cross-sectional view taken generally along line 9—9 of FIG. 8.

Referring more particularly to details of channel plate 10, it can be seen in FIGS. 8 and 9 that channels 28 extending through plate 10 each have an internal wall made up of contiguous alternate strips 30 and 32 of two different glasses, one of which has optimum electrical current conducting properties and the other has optimum electron emitting properties.

Strips 30 being representative of those having optimum electrical current conducting properties may be formed of a high lead or vanadium containing glass. Strips 32, representing those having high electron emitting properties may be formed of glass having a lower lead or vanadium content or be formed of any one of the common nonconductive glasses such, for example, as soda-line glass.

Faces 14 and 16 of plate 10 are provided with metallic electrodes 34, one of which is illustrated in FIG. 9. Electrodes 34 are formed of chromium or other suitable electrically conductive material preferably vacuum deposited discriminately around corresponding open ends of channels 28. An electrical potential of, for example, 1 KV applied across electrodes 34 accelerates electrons through channels 28. At each incidence of an electron upon a strip 32, the impact thereof against the particular strip 32 frees secondary electrons with the result of electron multiplication taking place along the lengths of the channels. This multiplication of electrons is illustrated diagrammatically by arrows 36 in FIG. 9 wherein at each incidence of an arrow 36 with a channel wall it can be seen that multiple emissions take place, each of which in turn becomes multiplied, and so on, throughout the length of the channel. The contiguous relationship of strips 30 and 32 makes possible a continuous supply of electrons to strips 32 from electrically conductive strips 30 which may also be at least partially secondary emissive to electrons of their own upon bombardment by electrons emitted from strips 32 and others being channeled through plate 10.

Figure 2:
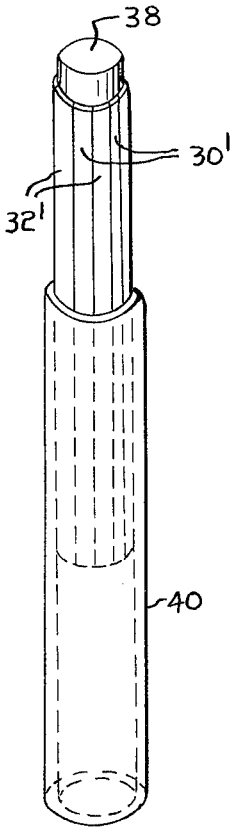

Channel plate 10 may be formed according to principles of this invention as follows:

A rod 38 (FIG. 2) of glass which may be subsequently dissolved in a medium such as dilute nitric acid is surrounded by alternate strips 30' and 32' of two different glasses selected to have the aforementioned different properties of high electrical conductivity and high secondary electron emission properties respectively. Rod 38 may, for example, be about one inch in diameter and several inches long with strips 30' and 32' of the same length and from 1 to 5 millimeters in width.

Figure 3:
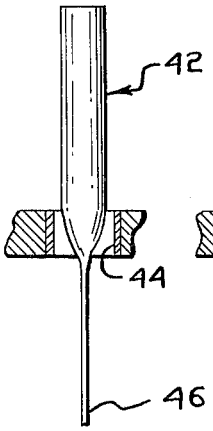

The assembly of rod 38 and strips 30', 32' is placed within glass tube 40 to form unit 42 shown in FIG. 3. Tube 40 is of a length at least sufficient to enclose the full length of the assembly of rod 38 and strips 30', 32'.

Figure 4:
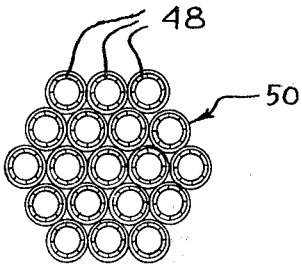
FIGS. 2–7 diagrammatically illustrate steps which may be taken according to principles of this invention in a method of producing multi-channel electron multiplier elements.

Unit 42 is heated adjacent one of its ends by means of heating element 44 and drawn into a fiber 46 of, for example, from one to two millimeters in diameter. Fiber 46 is cut into a number of lengths 48 which are bundled together preferably in a hexagonal array 50 as shown in FIG. 4. The array 50 of lengths 48 is heated adjacent one of its ends by heating element 52 and drawn as a unit into a multifiber 54. Multifiber 54 may be cut into a number of lengths, stacked together and redrawn into a multi-multifiber so as to reduce the size of pieces of rod 38 in each multifiber or multi-multifiber to a size equal to that desired of channels 28 in the finished plate 10. A typical channel diameter may range from about 10 to 30 microns.

Figure 5:
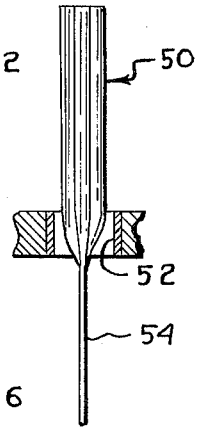

The multifiber 54 (FIG. 5) or a multi-multifiber formed of several lengths thereof, whichever has the desired core size, is cut into a number of lengths 56 which are stacked in side-by-side relationship with each other in a relatively large glass tube 58 (FIG. 6) and fused into a boule 60 having a diameter approximately equal to the diametral size desired of multi-channel plate 10.

A slight drawing of the assembly of lengths 56 of multifibers and tube 58 is preferably used during fusing thereof so as to eliminate voids between multifibers 56 in the fused boule 60.

Figure 7:
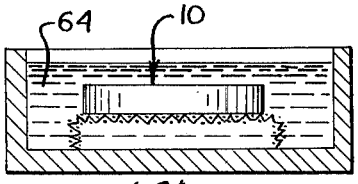

Plate 10 is cut from boule 60 by sawing therethrough along dot-dash outline 62 and opposite sides of the plate are ground and polished. Plate 10 is then immersed in an appropriate etching solution 64 (FIG. 7) such as dilute nitric acid, for example, for a period of time sufficient to cause removal of cores of fiber elements therein which comprise the acid-soluable material of rod 38. This produces channels 28 in plate 10. The etched plate is cleaned and dried.

In the case where strips 30 are formed of lead containing glasses the cleaned and dried plate is preferably fired in a reducing atmosphere to produce a lead-enriched surface along each channel wall so as to enhance the electrical conductivity of strips 30. The treatment of lead containing glasses in reduced atmospheres for the purpose just described is well-known to the artisan and is only used in cases where strips 30 and/or 32 are formed of lead containing or similar glasses wherein their surface conductivity may be enhanced by such treatment. In the case where strips 30 and 32 of channels 28 are formed of glasses having the desired properties of electrical conductivity and secondary electron-emission respectively in bulk form, the aforementioned post treatment in reducing atmospheres may be omitted.

Following the cleaning and drying operation and post treatment by firing, when used, metallic electrodes 34 of chromium or other suitable metal are vacuum deposited on faces 14 and 16 of plate 10.

Figure 6:
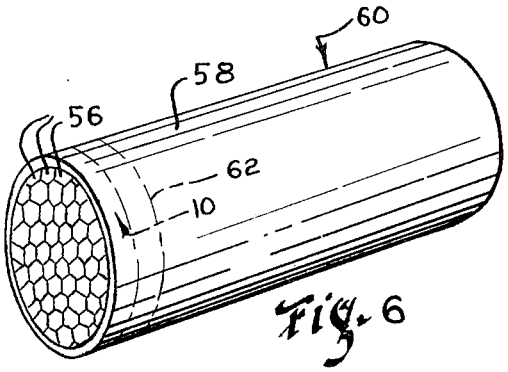

It should be apparent from FIG. 6 that a considerable number of channel plates 10 can be cut from boule 60 so that the performance of method steps illustrated by FIGS. 2–5 need only be carried out once for mass production of plates 10. It is also pointed out that, with ordinary skill of the artisan, all glasses of the assembly of elements 38, 30', 32' and 40 of unit 42 (FIGS. 2 and 3) as well as glass tube 58 (FIG. 6) are so selected as to be compatable in their coefficients of expansion and melting and fusing temperatures so that all fusing and drawing operations described hereinabove may be readily performed. Furthermore, the operations described in connection with FIGS. 2–6 are carried out with cooling and/or annealing steps used whenever necessary as determined by ordinary skill of the artisan.

I claim:

1. An electron multiplier component comprising a glass plate having a multiplicity of juxtapositioned channels extending from one face through the plate to an opposite face thereof, the inner wall of each channel being formed of a plurality of contiguous strips of glass extending along substantially the full length of the channel, said strips being alternately one of a glass having high electrical conductivity and another of a glass having high electron emissive properties and a matrix glass surrounding said strips.

2. An electron multiplier component according to claim 1 further including an electrically conductive coating on each of said faces of said plate applied to ends of said strips and matrix glass.

3. An electron multiplier component according to claim 1 wherein said alternate strips of glass are one of high lead content and the other being substantially free of lead.

4. An electron multiplier component according to claim 1 wherein said alternate strips of glass are one having a reducible metallic content and the other having a non-reducible metallic content.

* * * * *